US006733305B2

(12) United States Patent
Pan et al.

(10) Patent No.: US 6,733,305 B2
(45) Date of Patent: May 11, 2004

(54) BOARD-TO-BOARD ELECTRICAL CONNECTOR ASSEMBLY

(75) Inventors: Weihua Pan, Kunsan (CN); Xuegong Lei, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/463,977

(22) Filed: Jun. 17, 2003

(65) Prior Publication Data

US 2004/0018756 A1 Jan. 29, 2004

(30) Foreign Application Priority Data

Jul. 26, 2002 (TW) ..... 91211458 U

(51) Int. Cl.[7] ..... H01R 12/00

(52) U.S. Cl. ..... 439/74; 439/65; 439/660; 439/247

(58) Field of Search ..... 439/74, 660, 626, 439/78, 345, 346, 247, 248, 65, 680

(56) References Cited

U.S. PATENT DOCUMENTS 4,113,179 A * 9/1978 McKee ..... 439/354
5,626,482 A * 5/1997 Chan et al. ..... 439/74
5,842,875 A * 12/1998 Yagi ..... 439/74
5,860,814 A * 1/1999 Akama et al. ..... 439/74
5,873,742 A 2/1999 McHugh
5,971,800 A * 10/1999 Azuma et al. ..... 439/502
6,010,370 A * 1/2000 Aihara et al. ..... 439/660
6,095,824 A 8/2000 McHugh
6,155,886 A 12/2000 Koseki et al.
6,589,074 B1 * 7/2003 Wu ..... 439/540.1

* cited by examiner

*Primary Examiner*—Tho D. Ta
*Assistant Examiner*—Edwin A. Leon
(74) *Attorney, Agent, or Firm*—Wei Te Chung

(57) ABSTRACT

An electrical connector assembly (1) includes a first connector (10) having a first housing (100) receiving a plurality of first contacts (104) therein, and a second connector (20) having a second housing (200) receiving a plurality of second contacts (204) therein. The first housing defines two protruding blocks (1023) thereon and the second housing defines two sunken slots (2023) corresponding to the protruding blocks. When the first connector and the second connector are mated together, the cooperation of the protruding blocks and the sunken slots enhance the mating force between the two connectors. In an alternative embodiment, two protruding blocks are defined on a second housing and two sunken slots are defined on a first housing corresponding to the protruding blocks.

1 Claim, 3 Drawing Sheets

BOARD-TO-BOARD ELECTRICAL CONNECTOR ASSEMBLY

BACKGROUND OF THE INVENTION

1. Field of the Invention

The present invention relates to an electrical connector assembly used for electrically connecting two separate printed circuit boards (PCBs).

2. Description of the Prior Art

As detailed in pages 1737–1755 of *Proceedings of* 1990 *National Electronic Packaging and Production Conference* (*NEPCON WEST*'90) (*V*0 1.2), board-to-board electrical connectors have been widely used and applied in all kinds of electrical equipment to electrically connect two separate PCBs. Such board-to-board electrical connector assemblies having rectangular housings and contacts received in the housings are disclosed in U.S. Pat. Nos. 5,873,742, 6,155,886 and 6,095,824, In general, a board-to-board electrical connector assembly comprises two complementary connectors. When the two connectors are mated together, the mating force for connecting the two connectors firmly is provided by interference between the respective two housings. However, in order to provide the interference, the two housings have to deform relative to each other. After repeated use, the housings are liable to distort plastically. Once either housing has sustained plastic distortion, it does not rebound to its original shape, and weakens the interference between the two housings. As a result, the connectors may not engage with each other firmly and reliably.

Hence, a new board-to-board electrical connector assembly is required to overcome the above-described disadvantages.

SUMMARY OF THE INVENTION

An object of the present invention is to provide a board-to-board electrical connector assembly providing great mating forces that enable firm and reliable engagement between sub-parts of the assembly.

In order to achieve the aforementioned object, an electrical connector assembly in accordance with a preferred embodiment of the present invention comprises a first connector having a first housing receiving a plurality of first contacts therein, and a second connector having a second housing receiving a plurality of second contacts therein. The first housing defines two protruding blocks symmetrically and the second housing defines two sunken slots corresponding to the protruding blocks. When the first and the second connectors are mated together, the cooperation of the protruding blocks and the sunken slots enhance the mating force between the two connectors. In an alternative embodiment, two protruding blocks are defined on a second housing and two sunken slots are defined on a first housing corresponding to the protruding blocks.

Other objects, advantages and novel features of the present invention will become more apparent from the following detailed description when taken in conjunction with the accompanying drawings, in which:

DESCRIPTION OF THE PREFERRED EMBODIMENTS

Figure 1:
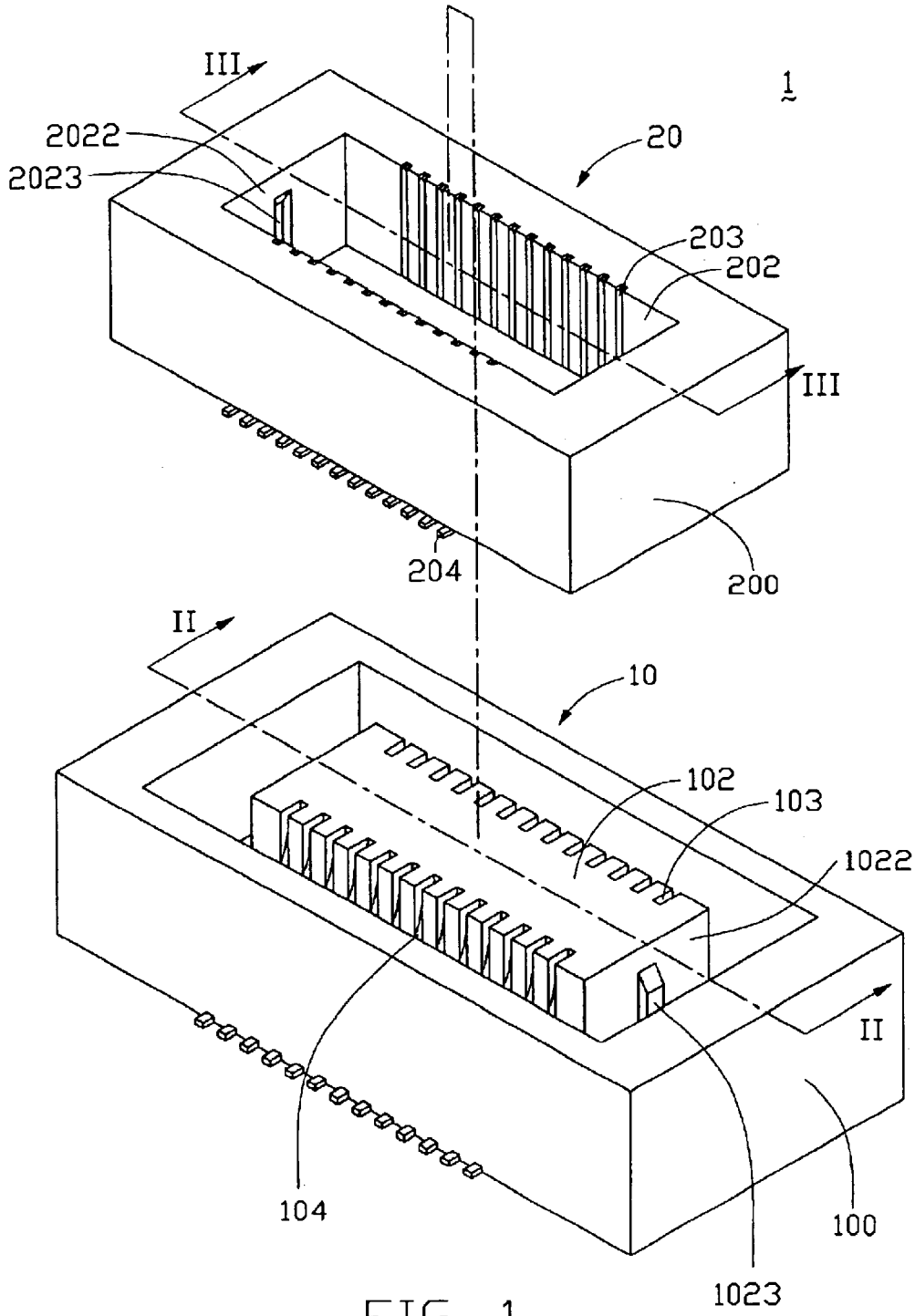
FIG. 1 is an exploded, isometric view of an electrical connector assembly in accordance with the preferred embodiment of the present invention.

Reference will now be made to the drawing figures to describe the present invention in detail.

Referring to FIG. 1, an electrical connector assembly 1 of the present invention comprises a first connector 10 and a second connector 20 each electrically connecting to a respective PCB (not shown). The first connector 10 comprises a longitudinal first housing 100. The first housing 100 forms a central island portion 102 surrounded by four connected sidewalls, the island portion 102 being separated from the sidewalls by a moat-like mating groove. The island portion 102 defines two first mating surfaces 1022 at opposite ends thereof respectively, and a plurality of first passageways 103 arranged along opposite longitudinal sides thereof. Each first mating surface 1022 forms a protruding block 1023 thereon, and each first passageway 103 receives a corresponding first contact 104 therein. The second connector 20 comprises a longitudinal second housing 200. The second connector 20 defines a central recess 202 surrounded by four connected sidewalls, the recess 202 receiving the island portion 102 of the first connector 10 therein. The recess 202 is bounded by two second mating surfaces 2022 at opposite ends thereof respectively. A plurality of second passageways 203 is defined in two opposite longitudinal of the sidewalls, each second passageway 203 receiving a corresponding second contact 204 therein. The two other sidewalls define a pair of sunken slots 2023 respectively at the second mating surfaces 2022. The sunken slots 2023 correspond to the protruding blocks 1023 of the first connector 10.

Figure 2:
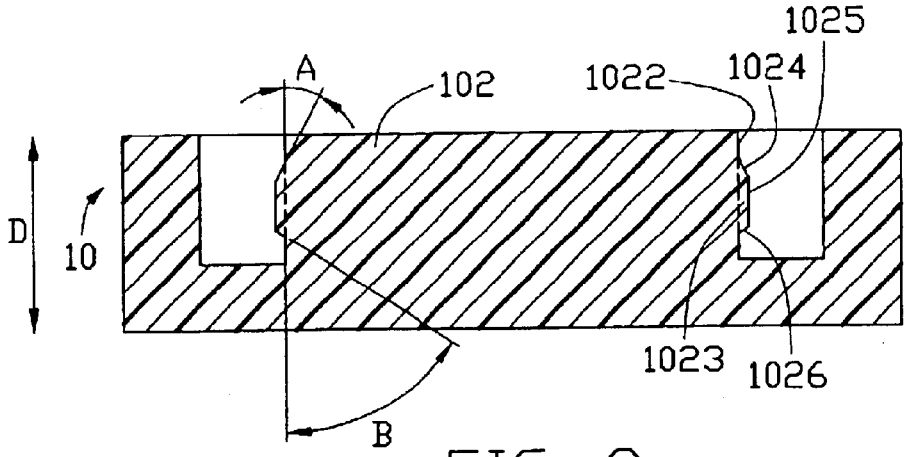
FIG. 2 is a cross-sectional view of a first housing of the electrical connector assembly of FIG. 1, taken along line II—II thereof.

Referring to FIG. 2, each protruding block 1023 of the first connector 10 defines an upper guiding surface 1024, a medial first connecting surface 1025, and a lower first hooking surface 1026. A vertical axis D is defined along directions in which the first connector 10 is inserted into the second connector 20 or removed from the second connector 20. The guiding surface 1024 forms an angle A relative to axis D. The first connecting surface 1025 is parallel to axis D, and the first hooking surface 1026 forms an angle B relative to axis D.

Figure 3:
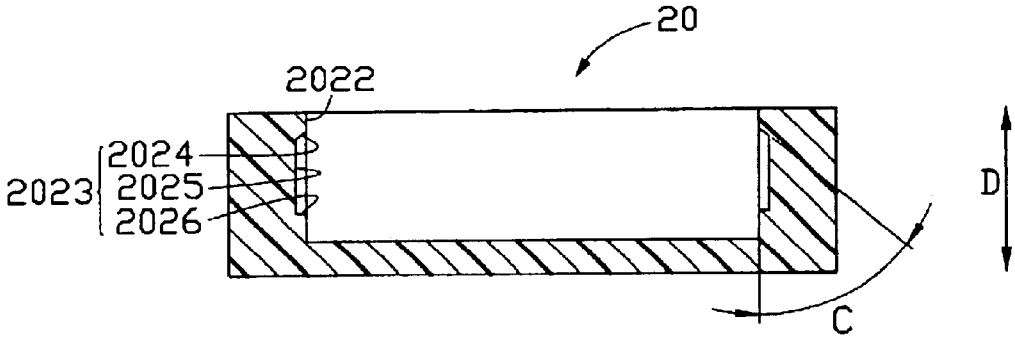
FIG. 3 is a cross-sectional view of a second housing of the electrical connector assembly of FIG. 1, taken along line III—III thereof.

Referring to FIG. 3, the sunken slot 2023 defined at each second mating surface 2022 of the second connector 20 is bounded by a lower second hooking surface 2024, a medial second connecting surface 2025, and an upper end surface 2026. The second hooking surface 2024 forms an angle C relative to axis D, with angle C being approximately equal to angle B. The second connecting surface 2025 is parallel to axis D, and the end surface 2026 is perpendicular to axis D.

Figure 4:
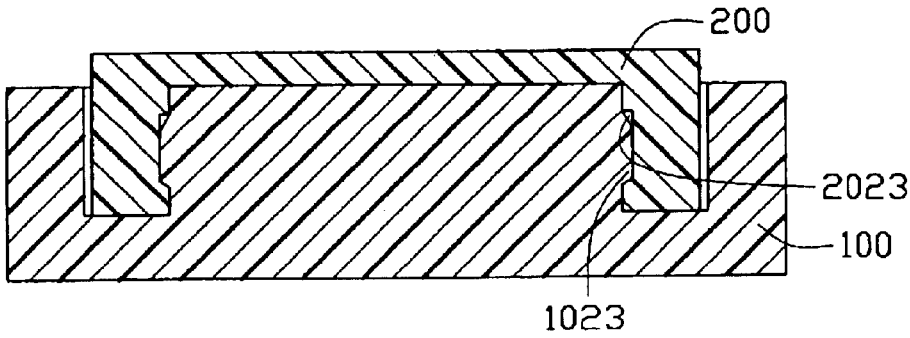
FIG. 4 is essentially a combination of FIGS. 2 and 3, showing the first and second housings mated together.

Referring to FIGS. 2–4, when the first connector 10 and the second connector 20 are mated together, the second housing 200 rides over the guiding surfaces 1024 and first connecting surfaces 1025 of the protruding blocks 1023. The protruding blocks 1023 thereby elastically deform the second housing 200 at the second mating surfaces 2022 until the protruding blocks 1023 are received in the corresponding sunken slots 2023. Angle B is approximately equal to angle C, therefore the first hooking surfaces 1026 are approximately parallel to the respective second hooking surfaces 2024. Thus the protruding blocks 1023 engage in the sunken slots 2023 with great mating forces. These mating forces provide firm and reliable engagement between the first and second connectors 10, 20.

Figure 5:
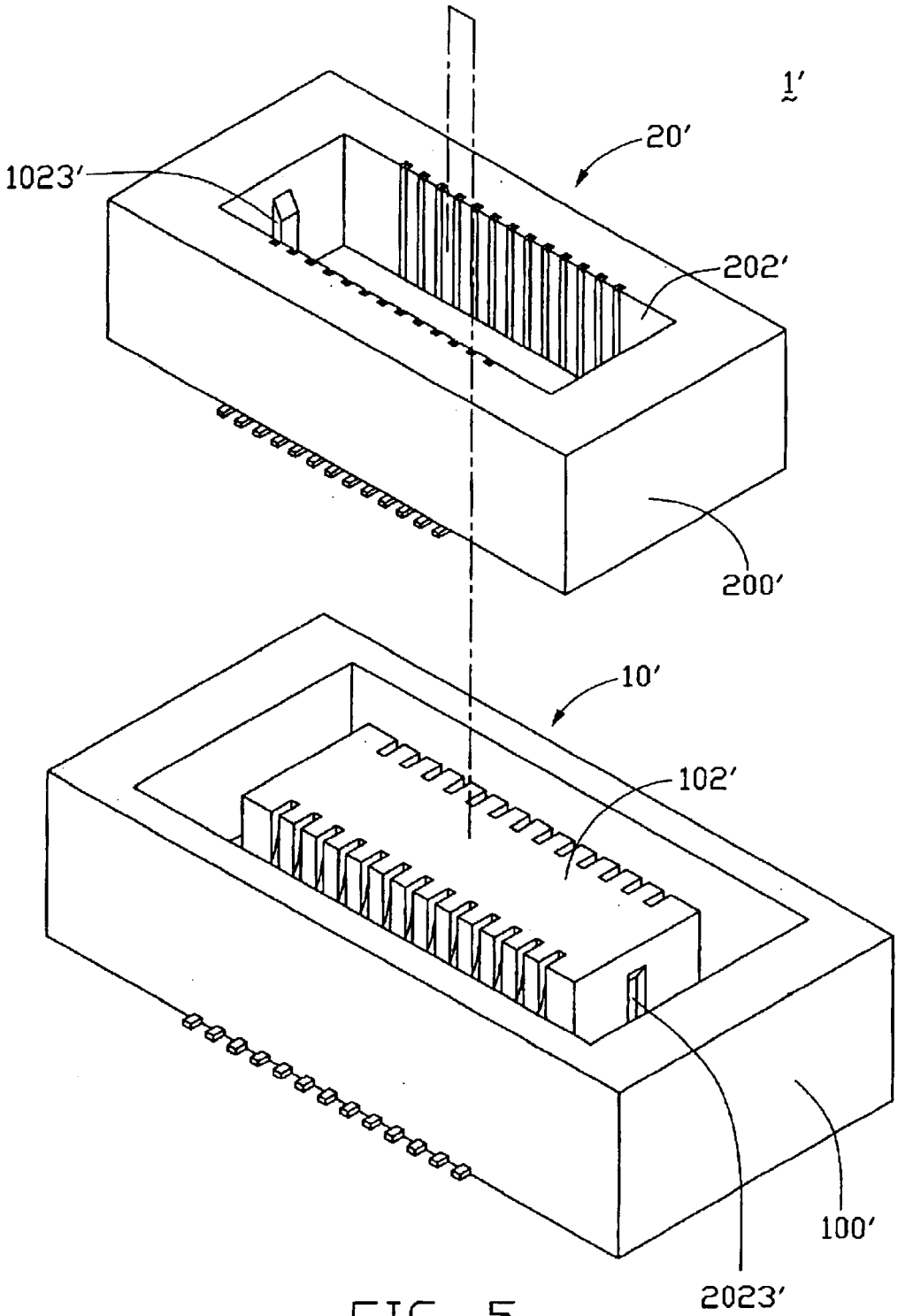
FIG. 5 is an exploded, isometric view of an electrical connector assembly in accordance with the alternative embodiment of the present invention.

Referring to FIG. 5, an electrical connector assembly 1' in accordance with an alternative embodiment of the present invention has a structure similar to that of the electrical connector assembly 1 of the preferred embodiment. The electrical connector assembly 1' comprises a first connector 10' having a first housing 100', and a second connector 20' having a second housing 200'. The first housing 100' forms an island portion 102', and the second housing 200' defines a recess 202' for receiving the island portion 102'. The island portion 102' defines two sunken slots 2023' in opposite ends thereof, and the second housing 200' forms two protruding blocks 1023' corresponding to the sunken slots 2023'. When the first and second connectors 10', 20' are mated together, the protruding blocks 1023' engage in the sunken slots 2023' with great mating forces, thereby providing firm and reliable engagement between the first and second connectors 10', 20'. The electrical connector assembly 1' can perform substantially the same functions as described above in relation to the electrical connector assembly 1 of the preferred embodiment.

While the present invention has been described with reference to specific embodiments, the description is illustrative of the invention and is not to be construed as limiting the invention. Various modifications can be made to the preferred embodiments by those skilled in the art without departing from the true spirit and scope of the invention as defined by the appended claims.

What is claimed is:

1. An electrical connector assembly used for electrically connecting two separate printed circuit boards comprising:

a first connector defining a first housing for receiving a plurality of first contacts, the first housing defining an island portion having two opposite first mating surfaces;

a second connector defining a second housing for receiving a plurality of second contacts, the second housing defining a recess having two opposite second mating surfaces; wherein, the first housing defines a protruding block on each of the two first mating surfaces respectively and the second housing defines a sunken slot on each of the two second mating surfaces respectively, each sunken slot being matching with the corresponding protruding block each protruding block defines an upper guiding surface, a medial first connecting surface and a lower first hooking surface, each sunken slot defines an upper end surface, a medial second connecting surface and a lower second hooking surface and wherein the guiding surface is not parallel to the first hooking surface.

* * * * *